US009899780B2

(12) United States Patent
Pocrass

(10) Patent No.: US 9,899,780 B2
(45) Date of Patent: Feb. 20, 2018

(54) RJ AND USB CONNECTORS WITH GROOVED CONTACT PINS

(71) Applicant: Alan L. Pocrass, Simi Valley, CA (US)

(72) Inventor: Alan L. Pocrass, Simi Valley, CA (US)

( * ) Notice: Subject to any disclaimer, the term of this patent is extended or adjusted under 35 U.S.C. 154(b) by 0 days.

(21) Appl. No.: 15/209,116

(22) Filed: Jul. 13, 2016

(65) Prior Publication Data

US 2017/0018865 A1 Jan. 19, 2017

Related U.S. Application Data

(60) Provisional application No. 62/231,813, filed on Jul. 15, 2015.

(51) Int. Cl.

| | |
|---|---|
| ***H01R 12/00*** | (2006.01) |
| ***H01R 24/64*** | (2011.01) |
| ***H01R 12/58*** | (2011.01) |
| ***H01R 12/72*** | (2011.01) |
| *H01R 13/6581* | (2011.01) |
| *H01R 107/00* | (2006.01) |

(52) U.S. Cl.
CPC ..... *H01R 24/64* (2013.01); *H01R 12/58* (2013.01); *H01R 12/724* (2013.01); *H01R 13/6581* (2013.01); *H01R 2107/00* (2013.01)

(58) Field of Classification Search
CPC ..... H01R 12/585
USPC ..... 439/620.23, 676, 733.1, 82, 78
See application file for complete search history.

(56) References Cited

U.S. PATENT DOCUMENTS 4,802,860 A * 2/1989 Kikuta ..... H01R 12/724 439/79
5,254,010 A * 10/1993 Davis ..... H01R 23/6873 439/108
5,915,979 A * 6/1999 Schell ..... H01R 12/57 439/326
6,095,827 A * 8/2000 Dutkowsky ..... H01R 12/57 439/326
6,183,302 B1 * 2/2001 Daikuhara ..... H01R 24/44 439/108
6,312,290 B1 * 11/2001 Belopolsky ..... H01R 13/6474 439/676
6,431,906 B1 * 8/2002 Belopolsky ..... H01R 13/641 439/490
6,431,917 B1 * 8/2002 Belopolsky ..... H01R 24/64 439/676
6,506,063 B1 * 1/2003 Moriwake ..... H01R 43/16 439/79
6,663,423 B2 * 12/2003 Belopolsky ..... H01R 13/7195 439/541.5
6,811,433 B2 * 11/2004 Jou ..... H01R 13/64 439/541.5

(Continued)

*Primary Examiner* — Tulsidas C Patel
*Assistant Examiner* — Peter G Leigh
(74) *Attorney, Agent, or Firm* — The Webb Law Firm

(57) ABSTRACT

A female electrical connector includes a number of walls defining a housing, a female connector inside the housing, and an opening configured to facilitate insertion of a mating male connector into the female connector. Contacts of the female connector are positioned in the opening of the housing. Contact pins extend from the contacts of the female connector through at least one of the walls of the housing for connection to a substrate. Each contact pin includes a curved or bent portion. The female electrical connector can be a USB or RJ-type connector.

17 Claims, 12 Drawing Sheets

(56) References Cited

U.S. PATENT DOCUMENTS 6,835,091 B2 * 12/2004 Oleynick ..... H01R 12/716 439/541.5
6,896,553 B2 * 5/2005 Espenshade ..... H01R 24/64 439/620.07
7,445,504 B1 * 11/2008 Zhang ..... H01R 12/712 439/607.01
7,632,111 B2 * 12/2009 Xiong ..... H01R 13/6461 439/660
7,708,603 B1 * 5/2010 Little ..... H01R 13/6464 439/676
7,798,832 B2 * 9/2010 Qin ..... H01R 13/7035 439/188
7,841,879 B2 * 11/2010 Nakamura ..... H01R 12/592 439/248
7,967,645 B2 * 6/2011 Marti ..... H01R 13/6658 439/676
8,002,571 B2 * 8/2011 Hogue ..... H01R 24/64 439/404
8,083,530 B2 * 12/2011 Kobayashi ..... H01R 13/658 439/607.04
8,133,069 B2 * 3/2012 Hogue ..... H01R 13/6464 439/404
8,545,240 B2 * 10/2013 Casher ..... H01R 29/00 439/108
2001/0000161 A1 * 4/2001 Laity ..... H01R 27/02 439/676
2008/0311778 A1 * 12/2008 Aekins ..... H01R 13/7033 439/344
2009/0061671 A1 * 3/2009 Qin ..... H01R 12/712 439/188
2009/0191740 A1 * 7/2009 Aekins ..... H01R 13/7033 439/218
2012/0122353 A1 * 5/2012 Nesme ..... H01R 24/64 439/676

* cited by examiner

TYPE A

TYPE B

MINI-A

MINI-B

MICRO-A

MICRO-B

RJ AND USB CONNECTORS WITH GROOVED CONTACT PINS

CROSS REFERENCE TO RELATED APPLICATION

This application claims the benefit of U.S. Provisional Patent Application No. 62/231,813, filed on Jul. 15, 2015, which is incorporated herein by reference.

BACKGROUND OF THE INVENTION

Field of the Invention

The present invention relates to electrical connectors, in general, and to RJ and USB connectors, in particular. More particularly, the present invention relates to the shape of contact pins used with RJ and USB connectors that, in use, are intended to be mounted on printed circuit boards (PCB).

Description of Related Art

Many prior art connectors, such as RJ and USB connectors, are designed with straight contact pins that are intended to be inserted into through-holes in printed circuit boards (PCBs) in use. The use of such prior art connectors with straight contact pins is well known in the art.

A common problem with insertion of such contact pins in through-holes of PCBs is bending of one or more of the contact pins due during insertion when mounting the connector to the PCB. It would be desirable to avoid this problem by providing a connector with an improved contact pin design.

SUMMARY OF THE INVENTION

Various preferred and non-limiting examples or aspects of the present invention will now be described and set forth in the following numbered clauses.

Clause 1. A female electrical connector comprising: a plurality of walls defining a housing, a female connector inside the housing, and an opening configured to facilitate insertion of a mating male connector into the female connector; contacts of the female connector positioned in the opening of the housing; and contact pins extending from the contacts of the female connector through at least one of the plurality of walls of the housing for connection to a substrate, wherein each contact pin includes a curved or bent portion.

Clause 2. The female electrical connector of clause 1, wherein each curved or bent portion comprises: a first, straight section extending in a first direction from one of the contacts; a second section extending from the end of the first section opposite the contact and away from the first direction; a third section extending from the end of the second section opposite the first section and toward the first direction; and a fourth, straight section extending from the end of the third section opposite the second section and in the first direction.

Clause 3. The female electrical connector of either clause 1 or 2, wherein: the first and second sections are positioned at a first angle to each other; and/or the second and third sections are positioned at a second angle to each other; and/or the third and fourth sections are positioned at a third angle to each other.

Clause 4. The female electrical connector of any of clauses 1-3, wherein: each angle is an obtuse or acute angle; and the transition between at least one of the first and second sections; the second and third section; and the third and fourth sections is sharp, curved, or both.

Clause 5. The female electrical connector of any of clauses 1-4, wherein: the second section extends away from the first section at a first, obtuse angle; and the first angle is sharp, curved, or both.

Clause 6. The female electrical connector of any of clauses 1-5, wherein: the third section extends away from the second section at a second, obtuse or acute angle; and the second angle is sharp, curved, or both.

Clause 7. The female electrical connector of any of clauses 1-6, wherein: the fourth section extends away from the third section at a third, obtuse angle; and the third angle is sharp, curved, or both.

Clause 8. The female electrical connector of any of clauses 1-7, wherein the first and fourth sections are aligned.

Clause 9. The female electrical connector of any of clauses 1-8, wherein the female connector is a USB connector or an RJ connector.

Clause 10. The female electrical connector of any of clauses 1-9, wherein the substrate is a PCB.

Clause 11. The female electrical connector of any of clauses 1-10, wherein electromagnetic interference (EMI) shielding defines one or more of the plurality of walls.

Clause 12. The female electrical connector of any of clauses 1-11, wherein the EMI shielding: defines a top wall of the housing; and covers side walls of the housing.

Clause 13. The female electrical connector of any of clauses 1-12, wherein the contact pins extend from a bottom wall of the housing.

DESCRIPTION OF THE INVENTION

Figure 1:
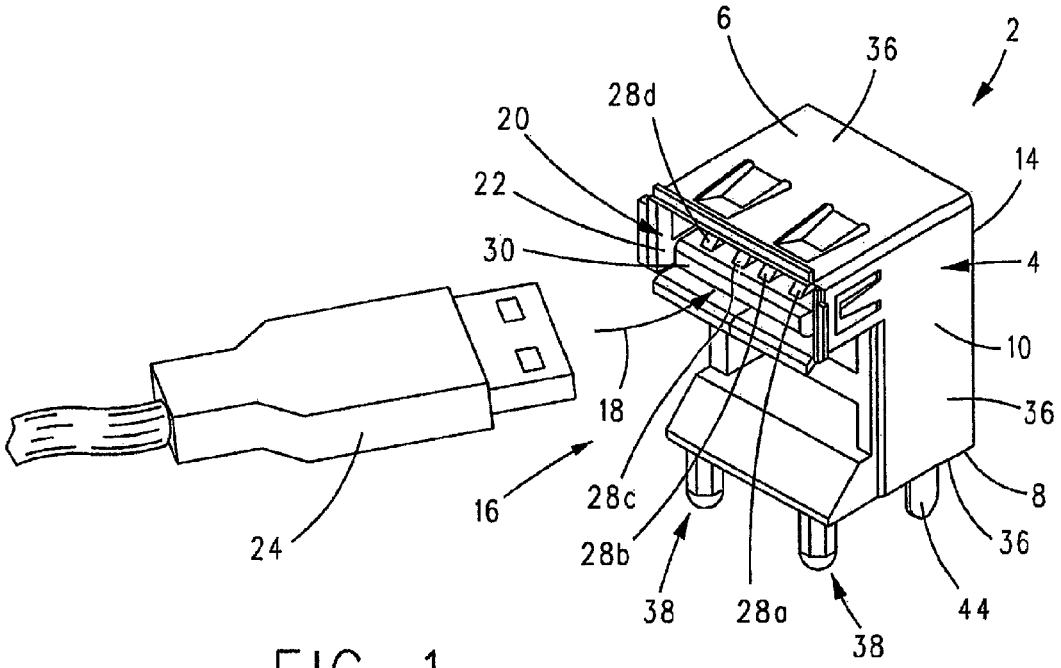
FIG. 1 is a perspective view of an embodiment high profile female (type-A) USB connector.
Figure 2:
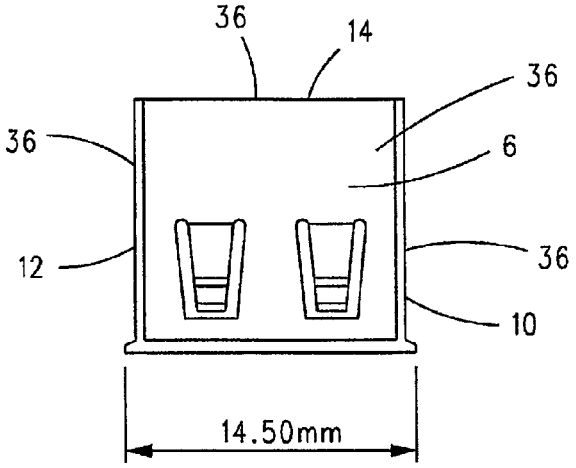
FIG. 2 is top view of the high profile female USB connector of FIG. 1.

The following examples will be described with reference to the accompanying figures, where like reference numbers correspond to like or functionally equivalent elements. Persons of ordinary skill in the art will realize that the following examples are illustrative only and that are not in any way limiting. Other examples will readily suggests themselves to such skilled persons.

The dimensions shown in the figures are in millimeters (mm) and are representative of the example connector described herein. However, these dimensions are not to be construed in the limiting sense since the use of other dimensions are envisioned.

With reference to FIGS. 1-5, a high profile USB connector 2 includes a housing 4 having a top wall 6, a bottom wall 8, a left side wall 10, a right side wall 12, a back wall 14, and a front wall 16.

Connector 2 includes a female USB connector 20 inside of housing 4. Front wall 16 of housing 4 includes an opening 22 having a height H and a width W configured to facilitate insertion of a mating male USB connector 24 into female USB connector 20 when male USB connector 24 is moved in the direction of arrow 18 into female USB connector 20.

Female USB connector 20 includes contacts 28A-28D disposed on a top surface of a USB printed circuit board (PCB) 30 which is positioned inside the cavity opening 22 of female USB connector 20. Female USB connector 20 also includes contact pins 26A-26D which extend from contacts 28A-28D, respectively through female USB connector 20 through at least one of the walls of housing 2, e.g., bottom wall 8, for connection to a substrate, such as, for example, a mounting PCB 32.

Housing 4 includes electromagnetic interference (EMI) shielding 36 on one or more of the walls of housing 4, e.g., without limitation, walls 6, 10, 12, 14, and, optionally, wall 8. FIGS. 2, 3B, 4B, and 5 include exemplary dimensions of connector 2. These dimensions, however, are not to be construed as limiting the invention.

Extending from bottom wall 8 of housing 4 is one or more snap fit connections 38. Each snap fit connection 38 includes at least a partial rim 40 and a distal end 42 that is adapted to compress laterally upon initial insertion into an opening 34 of mounting PCB 32 and expand laterally upon passage of partial rim 40 through said opening 34. The construction and operation of snap fit connection 38 is known in the art.

Shielding 36 includes one or more shield tabs 44 coupled to shielding 36 and extending from housing 2, e.g., away from bottom wall 8, for receipt and affixing in mating receptacles (not shown) of mounting PCB 32 by any means known in the art, e.g., press fit, soldering, etc.

Desirably, female USB connector 20 is positioned horizontally in housing 2. However, it is envisioned that female USB connector 20 can be positioned vertically in housing 2.

Figure 3A:
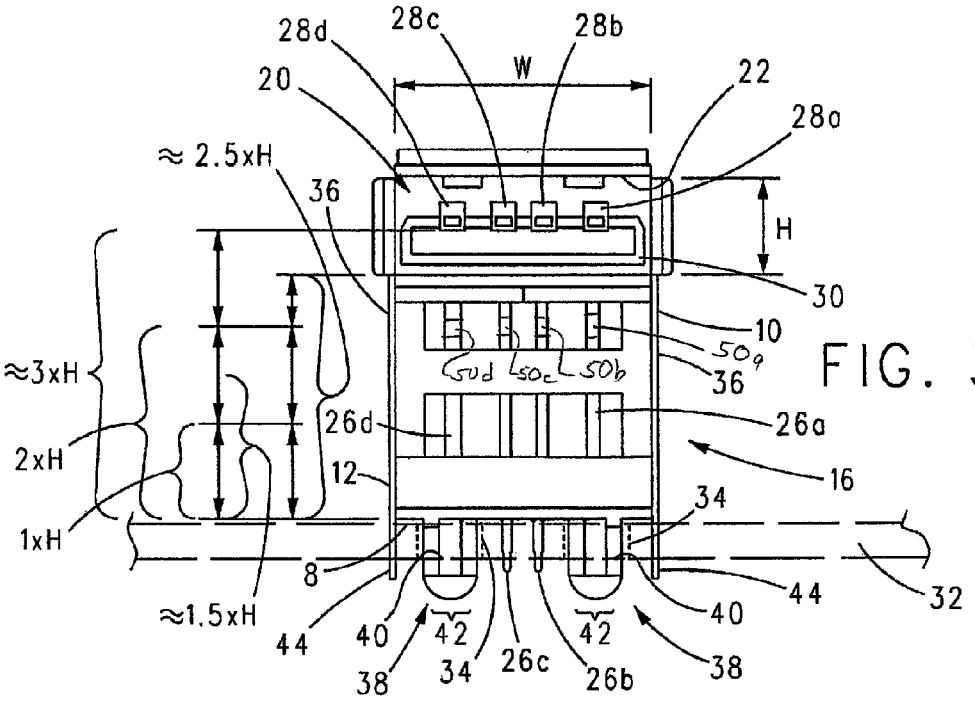
FIG. 3A is a front view of the high profile female USB connector of FIG. 1.

Desirably, a distance between an exterior of bottom wall 8 of housing 2 and a bottom surface of one of the contacts 28 that is closest to said exterior bottom wall 8 is at least 1.5×H, where H is the height of opening 22. More desirably, the distance between exterior bottom wall 8 and the bottom surface of one of the contacts 28 is at least 2×H and, more preferably, 3×H—all as shown in FIG. 3A.

Figure 4A:
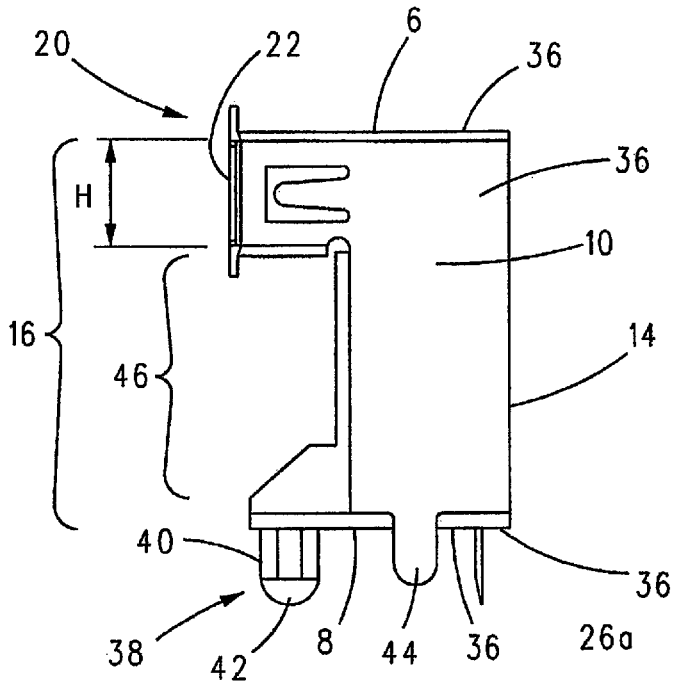
FIG. 4A is a left side view of the high profile female USB connector of FIG. 1.
Figure 4B:
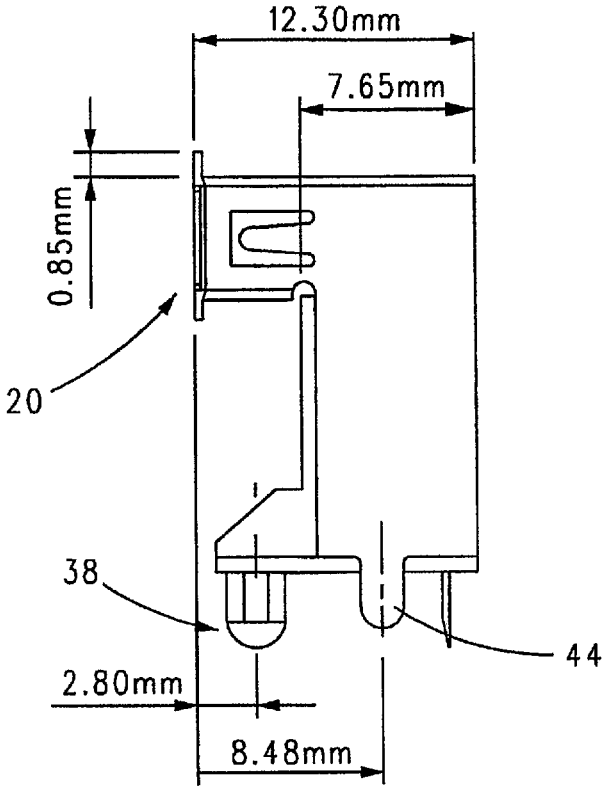
FIG. 4B is another left side view of the high profile female USB connector of FIG. 1 including exemplary, non-limiting dimensions.
Figure 5:
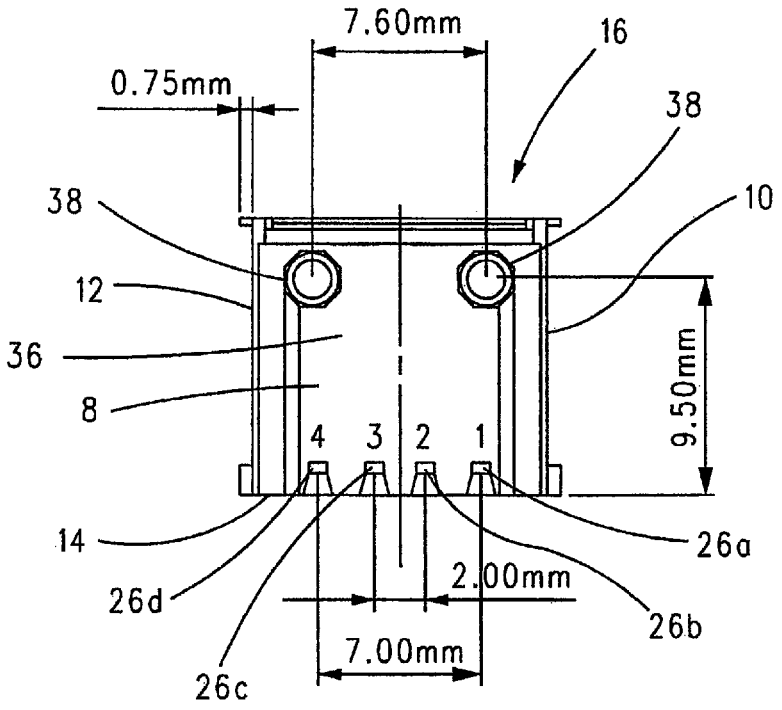
FIG. 5 is a bottom view of the high profile female USB connector of FIG. 1 including exemplary, non-limiting dimensions.
Figure 6A:
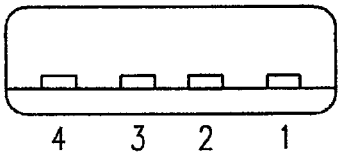
FIG. 6A (PRIOR ART)
FIGS. 6A-6F are schematic views of prior art USB connectors including respective Standard Type-A and Type-B, Mini-A and Mini-B, and Micro-A and Micro-B.
Figure 6B:
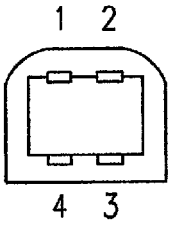
FIG. 6B (PRIOR ART)
Figure 6C:
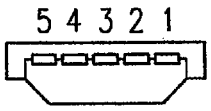
FIG. 6C (PRIOR ART)
Figure 6D:
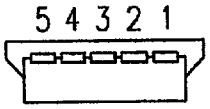
FIG. 6D (PRIOR ART)
Figure 6E:
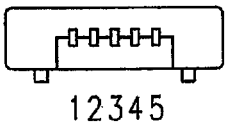
FIG. 6E (PRIOR ART)
Figure 6F:
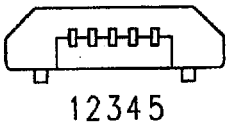
FIG. 6F (PRIOR ART)

As shown best in FIG. 4A, front wall 16 of housing 2 includes, between cavity opening 22 and bottom wall 8, an optional section 46 that is recessed toward back wall 14 of housing 2, whereupon female USB connector 20 is cantilevered over a space in front of recessed section 46 of front wall 16. The construction of housing 4 with front wall 16 having recessed section 46 and with female USB connector 20 cantilevered over the space in front of recessed section 46 of front wall 16, however, is not to be construed as limiting the invention since it is envisioned that recessed section 46 can be omitted whereupon housing 4 has more of a box-like shape.

As can be seen, between female USB connector 20 and the exterior of bottom wall 8 of housing 4, housing 4 does not house another connector. In other words, no other connector of any type resides between female USB connector 20 and bottom wall 8 of housing 4.

Figure 7:
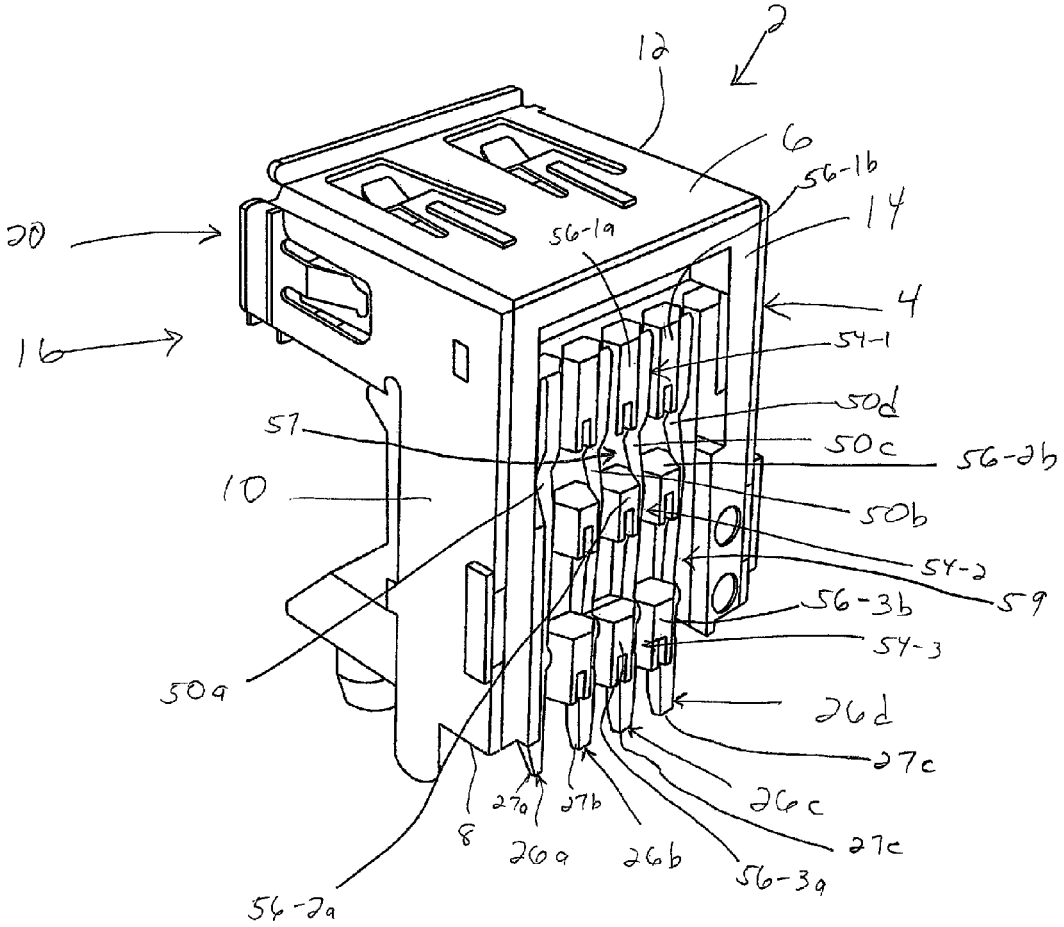
FIG. 7 is a perspective view of the example high profile female USB connector of FIGS. 1-5 showing the top wall, the left side wall, and the back wall; wherein the back wall includes an opening showing contact pins, including curved, grooved, or bent portions.
Figure 8:
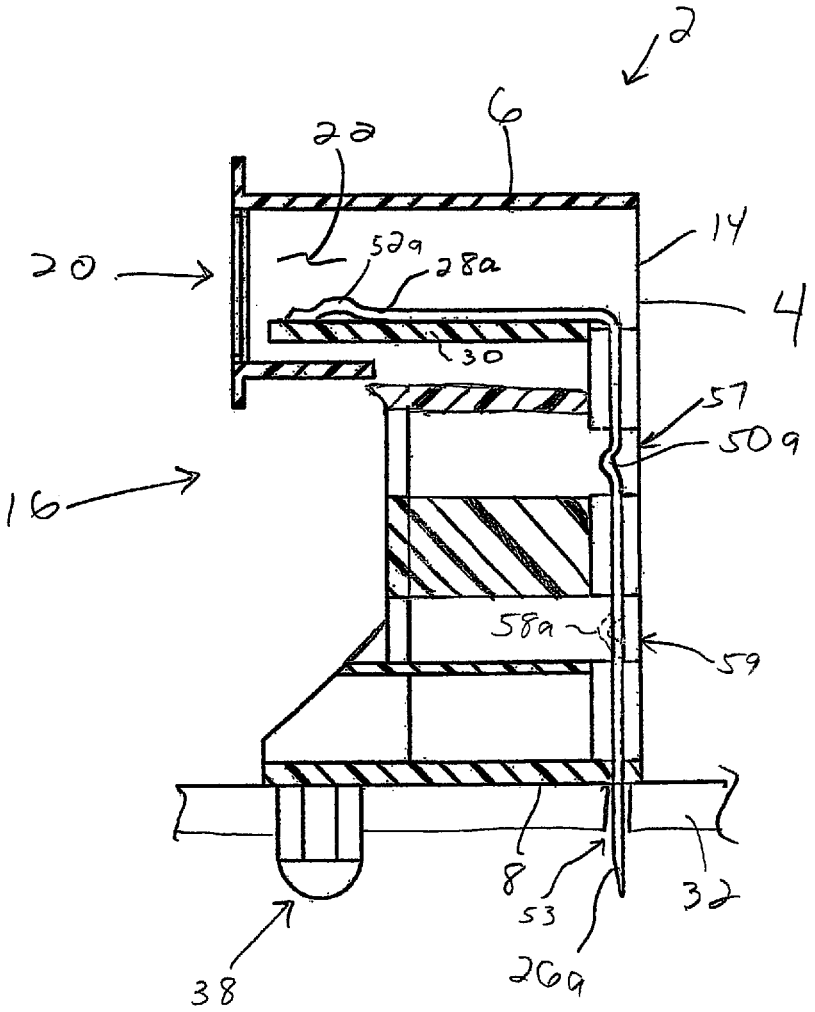
FIG. 8 is a cross-section taken along lines VIII-VIII in FIG. 3B.

With reference to FIGS. 7 and 8 and with continuing reference to all previous FIGS., each contact pin 26 can include a curved, grooved, or bent portion or segment 50 along the length of contact pin 26 between contact 28 and a distal end 27 of said contact pin 26. For example, contact pin 26*a* includes curved or bent portion 50*a*; contact pin 26*b* includes curved or bent portion 50*b*; contact pin 26*c* includes curved or bent portion 50*c*; and contact pin 26*d* includes curved or bent portion 50*d*.

It has been observed that when mounting prior art USB connectors onto mounting PCB 32 the straight contact pins of such connectors were prone to bending during insertion into through-holes 53 of the mounting PCB 32. A benefit of having a contact pin 26 include a curved or bent portion 50 is increased ability to avoid bending of the contact pin 26 during insertion into a through-hole. Moreover, where a connector has a number of contact pins with curved or bent portions 50, such contact pins stay aligned better with each other without bending during insertion of said contact pins into through-holes in mounting PCB 32.

In an example, each curved or bent portion 50 resides within housing 4 or within an outline of housing 4. In the example shown in FIG. 7, housing 4 has an open back wall 14. However, this is not to be construed in a limiting sense since it is envisioned that back wall 14 of housing 4 can be enclosed whereupon contact pins would not be visible via said enclosed back wall.

Figure 3B:
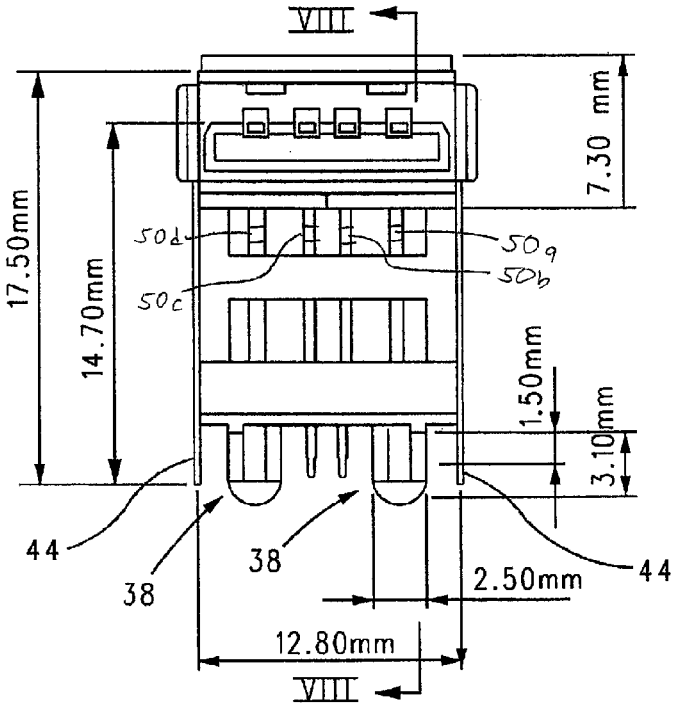
FIG. 3B is another front view of the high profile female USB connector of FIG. 1 including exemplary, non-limiting dimensions.

As shown in the cross-section of FIG. 8, which is a cross-section taken along lines VIII-VIII in FIG. 3B, each contact 28 includes a bent portion 52 that mates with a corresponding contact of a mating male USB connector 24 in a manner known in the art. In FIG. 8, contact 28A is shown as including bent portion 52A. It is to be appreciated that each bent portion 52 may not be the same and can serve a different purpose as curved or bent portion 50 of a contact pin 26. To this end, curved or bent portion 50, which can be part of an otherwise straight section of the contact pin 26, is provided in a space between a pair of channels of the housing through which straight sections of the contact pin on opposite sides of the curved or bent portion pass, and the curved or bent portion of each contact pin is free to move in said space to make the corresponding contact pin 26 less prone to bending during insertion into through-holes in mounting PCB 32 and to enable adjacent contact pins 26 to remain better aligned with each without bending during insertion into through-holes 53 of mounting PCB 32.

In an example, each curved or bent portion 50 can facilitate the formation of each contact pin 26 as short as possible within housing 4, which can be helpful for forming low profile connectors which have a reduced housing height. Moreover, each curved or bent portion 50 facilitates proper alignment of the corresponding contact pin 26 and contact 28 during assembly of connector 2.

Furthermore, the use of the curved or bent portion 50 of each contact pin 26 provides said contact pin 26 with additional strength to keep it from bending inside housing 4 and the portion of contact pin 26 outside of housing 4 from bending during insertion into a through-hole 53 of mounting PCB 32. Moreover, the curved or bent portion 50 of each contact pin 26 enables the formation of longer contact pins 26 of connectors 2 when stacked together in a common housing, whereupon this added length facilitates contact pins 26 being less prone to bending during insertion into through-holes in a mounting PCB 32 which, in-turn, facilitates insertion of the distal end of each contact pin 26 in a through-hole 53 of mounting PCB 32. Another advantage of the curved or bent grooved portion 50 of each contact pin 26 is improved assembly, wherein said curved or bent portion 50 avoids deformation of contact pin 26 during the assembly of connector 2.

As can be seen in FIG. 8, the position of curved or bent portion 50 does not reside in the portion of opening 22 of connector 2. Rather, curved or bent portion 50 resides in a section outside of opening 22 between contact 28 and the distal end of contact pin 26.

While FIGS. 7 and 8 show the curved or bent portion 50 of contact pin 26 located in back wall 14 of housing 4, this is not to be construed in a limiting sense since it is envisioned that the location of each curved or bent portion 50 of contact pin 26 in different style RJ connectors can be located elsewhere. For example, in an RJ connector intended for vertical mounting, the curved or bent portion 50 of contact pin 26 can reside external to housing 4.

In the example shown in FIGS. 7 and 8, one or more contact pins 26 can reside in a series of channels of housing 4, e.g., without limitation, channels 54-1, 54-2, and 54-3 formed by adjacent pairs of projections, e.g., (56-1*a*, 56-1*b*); (56-2*a*, 56-2*b*); and (56-3*a*, 56-3*b*), respectively. In this example, each curved or bent portion 50 resides in a horizontal space 57 between projections (56-1*a*, 56-1*b*) and (56-2*a*, 56-2*b*). However, this is not to be construed in a limiting sense since it is envisioned that each curved or bent portion 50 can alternatively reside in the space 59 between projections (56-2*a*, 56-2*b*) and (56-3*a*, 56-3*b*), as shown in phantom by reference number 58*a* in FIG. 8, or any other suitable and/or desirable position along the length of contact pin 26. In addition, while each contact pin 26 has been described as having a single curved or bent portion 50, it is envisioned that each contact pin 26 can include multiple curved or bent portions along its length, as shown in phantom by reference numbers 50*a* and 58*a* (in phantom) in FIG. 8. Where a contact pin 26 includes multiple curved or bent portions, each curved or bent portion can extend in the same or a different direction.

Figure 9:
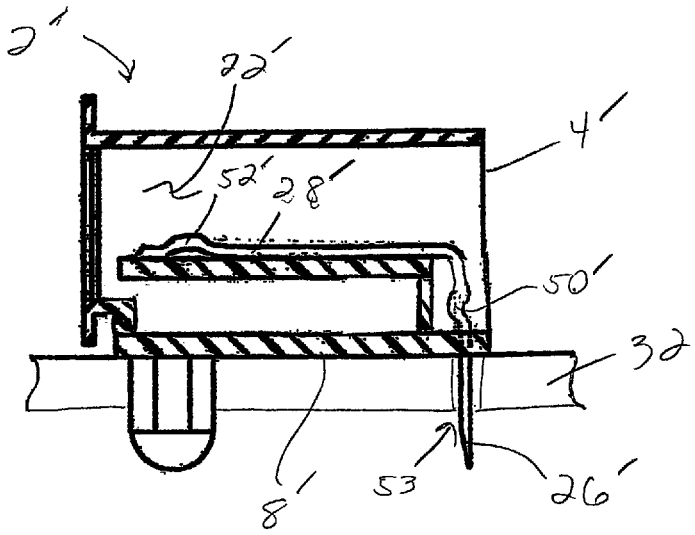
FIG. 9 is a cross-section of an example low profile female USB connector having a contact pin, including a curved, grooved, or bent portion.

With reference to FIG. 9 and with continuing reference to FIGS. 1-5, 7, and 8, the use of contact pins 26 having curved or bent portions 50 is not limited to the high-profile USB connector 2 previously described. To this end, a low-profile USB connector 2' can also include one or more contact pins 26' that can include one or more curved or bent portions 50' between the corresponding contact 28 and a distal end of contact pin 26' that, in use, is mounted through a through-hole 53 of mounting PCB 32. In an example, the curved or bent portion 50' of contact pin 26' of the low-profile USB connector 2' shown in FIG. 9 is included within housing 4' or within the outline of housing 4'. However, this is not to be construed in a limiting sense.

In an example, because of its low profile, low-profile USB connector 2' can exclude channels 54 between adjacent pairs of projections 56, as shown in FIG. 7. However, this is not to be construed in a limiting sense since it is envisioned that one or more channels 54 can be provided in low-profile USB connector 2' to aid an alignment of each contact pin 26' and the curved or bent portion 50' thereof.

FIG. 9 shows a single contact 28 and corresponding contact pin 26' of low-profile USB connector 2'. However, this is not to be construed in a limiting sense since, in practice, low-profile USB connector 2' will have a plurality, for example, four, contacts 28' and four corresponding contact pins 26', like the high-profile USB connector 2, shown in FIG. 7.

Figure 10:
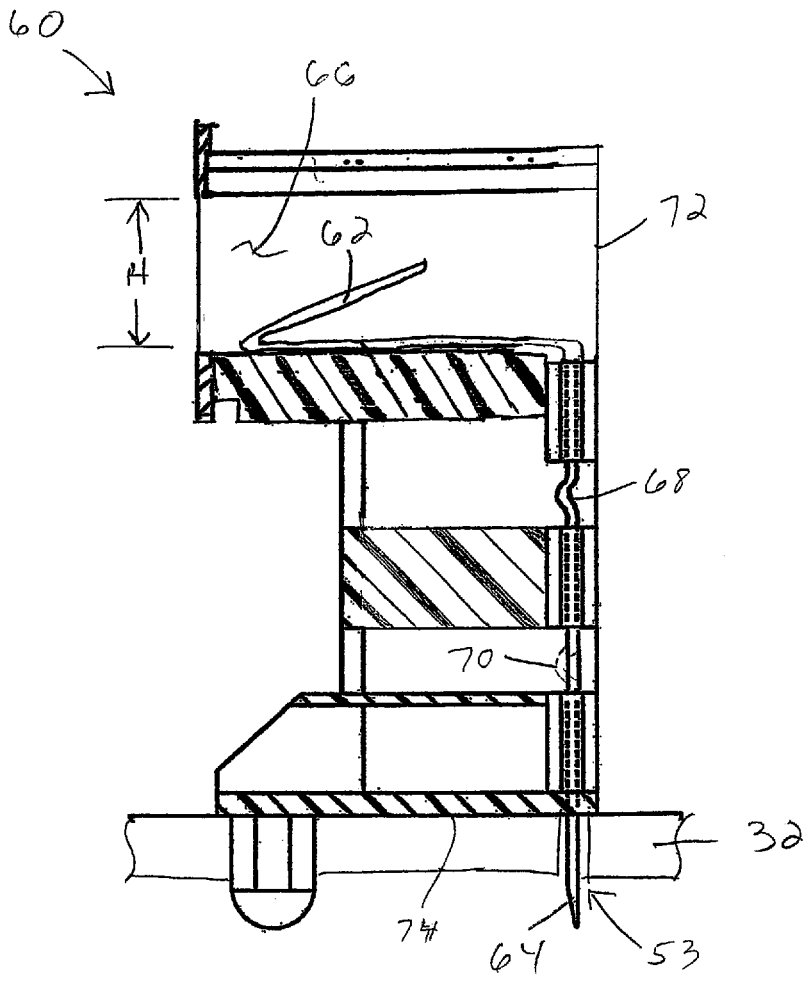
FIG. 10 is a cross-section of a high profile female RJ connector having a contact pin, including a curved, grooved, or bent portion.

With reference to FIG. 10, and with continuing reference to all previous figures, in another example, an RJ female connector 60, shown in cross-section in FIG. 10, includes RJ-type contacts 62 inside an RJ-shaped cavity opening 66 of RJ connector 60. Cavity opening 66 is configured to mate with a mating male RJ-type connector (not shown). Female RJ connector 60 also includes contact pins 64, which extend from contact 62. In FIG. 10, a single contact 62 and corresponding contact pin 64 are shown. However, it is to be appreciated that female RJ connector 60 can include a plurality of contacts 62 and contact pins 64. In an example, female RJ connector 60 can include eight contacts 62 and eight corresponding contact pins 64. However, this is not to be construed in a limiting sense.

In the cross-sectional side view of high-profile female RJ connector 60 shown in FIG. 10, contact pin 64 can include a curved or bent portion 68 anywhere along its length between contact 62 and a distal end of contact pin 64. In another example, contact pin 64 can include curved or bent portion 68 and one or more additional curved or bent portions 70 (shown in phantom).

In an example, the plurality of contact pins 64 of female RJ connector 60 can be positioned one behind the other in the view shown in FIG. 10. However, this is not to be construed in a limiting sense since it is envisioned that the plurality of contact pins 64 can be arrayed in any suitable and/or desirable manner. Similar comments apply in respect of the contact pins 26 and 26' of the high and low profile USB connectors 2 and 2' discussed above.

In an example, each contact pin 64 resides within the housing 72 or an outline of housing 72 of high-profile RJ connector 60. However, this is not to be construed as in a limiting sense since it is envisioned that one or more or all of contact pins 64 can reside outside of housing or the outline of housing 72. Similar comments apply in respect of the contact pins 26 and 26' of the high and low profile USB connectors 2, 2' discussed above.

Figure 11:
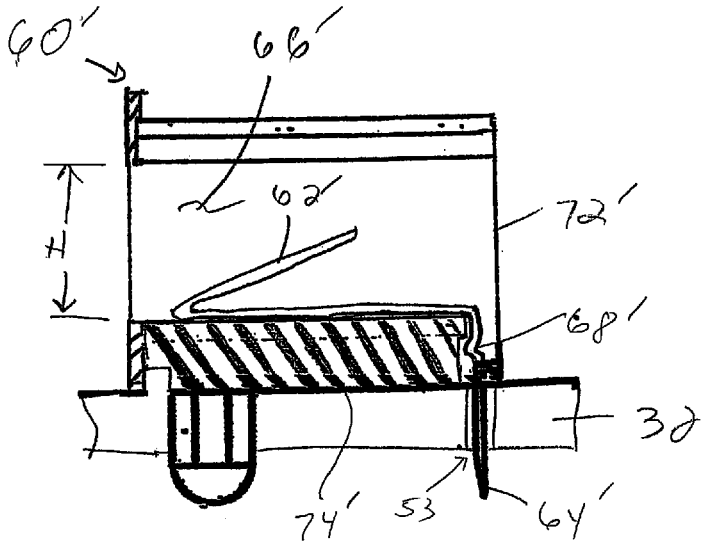
FIG. 11 is a cross-section of a low profile female RJ connector having a contact pin, including a curved, grooved, or bent portion.

With reference to FIG. 11 and with continuing reference to FIG. 10, the use of curved or bent portions 68 of contact pin 64, shown in FIG. 10, is also applicable to a low-profile RJ connector 60', shown in FIG. 11.

It is to be understood that the low-profile female RJ connector 60' shown in FIG. 11 includes a plurality of contacts 62' and corresponding contact pins 64', with each contact pin 64' including a curved or bent portion 68'.

In FIG. 10, a distance between an exterior bottom wall 74 of housing 72 and a bottom surface of one of the contacts 62 that is closest to said exterior bottom wall 74 is at least 1.5×H, where H is the height of RJ opening 66. In another example, the distance between exterior bottom wall 74 and the bottom surface of one of the contacts 62 can be at least 2×H. In another example this distance can be at least 3×H.

In an example, the high profile USB and RJ connectors 2 and 60 shown in FIGS. 8 and 10 are similar in many respects, with at least the following exceptions: high profile USB connector 2 includes a USB-shaped opening 22 while high profile RJ connector 60 includes an RJ-shaped opening 66. Moreover, high profile USB connector 2 includes USB-style contacts 52 while high profile RJ connector 60 includes RJ-style contacts 62. Similar comments apply in respect of the low-profile female USB connector 2' and the low-profile female RJ connector 60', shown in FIGS. 9 and 11, respectively.

As can be seen in FIGS. 8 and 10, the high-profile female USB and RJ connectors 2, 60 have their respective cavity openings 22, 66 positioned in elevated spaced relation to a surface of a substrate (e.g., mounting PCB 32) to which the high-profile connector is mounted. This higher elevation enables the connector to be mounted away from an edge of the substrate while still enabling plugging and unplugging of the mating male connector into the female cavity opening. This higher elevation also facilitates mounting of one or more components to the substrate below and in front of the female cavity opening while also enabling plugging and unplugging of the mating male connector into the female cavity opening above said components.

Regardless of the type of connector, namely, USB or RJ, the one or more curved or bent portions of each contact pin avoids bending of the contact pin during insertion into a through-hole of a mounting PCB and enables a number of contact pins of the connector to stay more aligned relative to each other without bending during insertion of said contact pins into the through-holes of the PCB. While the contact pins described herein are illustrated and described as extending from a bottom wall of each illustrated connector, as discussed above, it is also envisioned that the contact pins, including one or more curved or bent portions, can extend from a back wall of one or more of the example connectors disclosed herein, e.g., where said connectors are intended for mounting with the cavity opening facing upward, away from the mounting surface of the mounting PCB.

The one or more curved or bent portions of each contact pin described also herein enable the contact pin to be as short as possible inside the housing, which is beneficial for low and high profile connectors.

In an example, each curved or bent portion of a single contact pin or the curved or bent portions of different contact pins can be the same or a different size depending on the length of the contact pin. Advantages of the curved or bent portions of contact pins of various lengths is that for a housing having two or more stacked openings, the curved or bent portion of the contact pins associated with each opening avoid bending of contact pins during insertion into a through-hole, keeps it from bending inside the housing, and keeps the portion outside the housing from bending during insertion into a through-hole of a mounting PCB. Hence, it is possible to make the contact pins longer for female connectors that are stacked vertically together, whereupon the contact pins having the added length will avoid bending during insertion into through-holes of a mounting PCB.

Figure 12A:
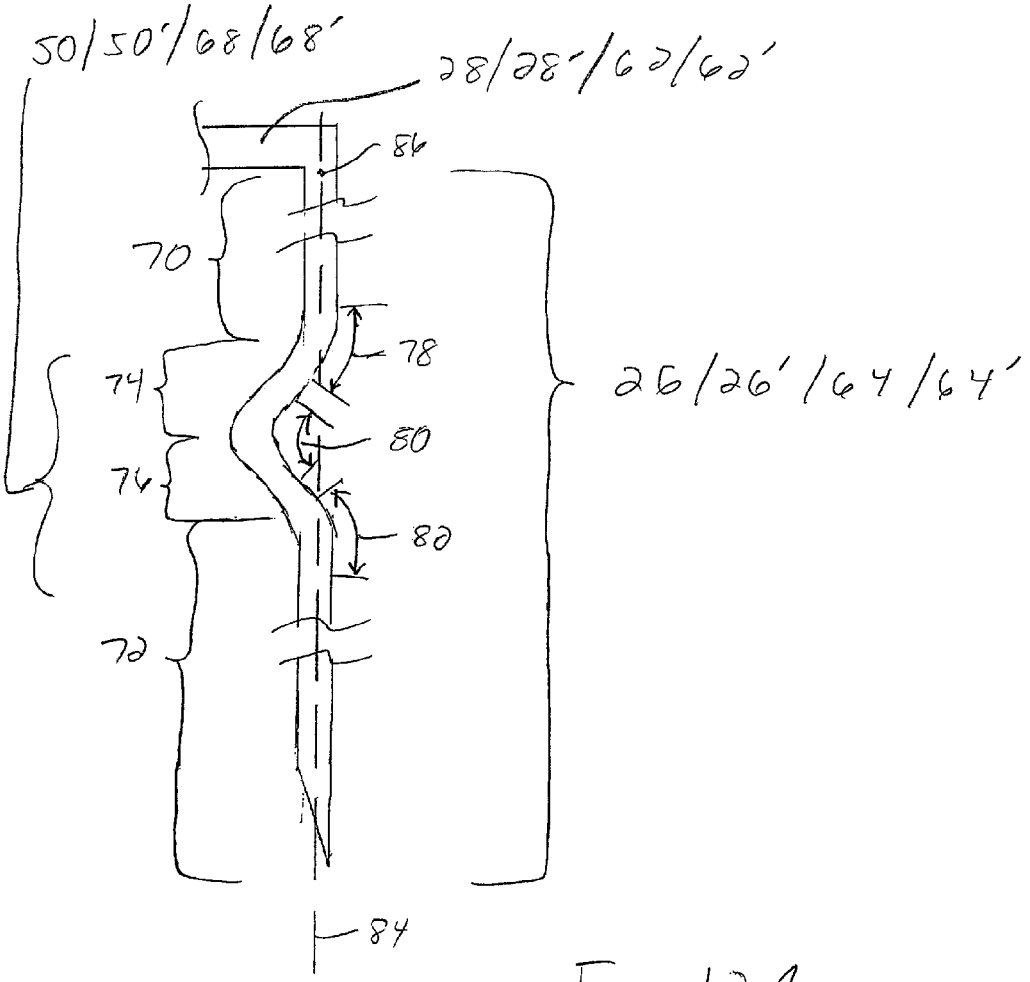
FIG. 12A is an isolated view of an example single contact pin coupled to a contact, wherein the contact pin includes a curved portion.

Referring to FIG. 12A, in an example, each contact pin described above can include a proximal end 70 that connects to a corresponding contact of the connector. The connector can also include a distal end 72, at least a portion of which is intended to be inserted into a through-hole of a substrate, such as mounting PCB 32. Between proximal end and distal end, the contact pin can include a curved portion (50/50'/68/68') that includes an upper part 74 connected to proximal end 70 and a lower part 76 connected to distal end 72. In the example shown in FIG. 12, a transition 78 between proximal end and upper part 74 can be curved having a radius of any extent deemed suitable and/or desirable by one of ordinary skill in the art. Similarly, the transition 80 between upper part 74 and lower part 76 can be curved having a radius of any extent deemed suitable and/or desirable by one of ordinary skill in the art. Finally, the transition 82 between lower part 76 and distal end 72 can be curved having a radius of any extent deemed suitable and/or desirable by one of ordinary skill in the art.

In the example shown in FIG. 12A, proximal end 70 and distal end 72 can be aligned along the same axis 84. However, this is not to be construed in a limiting sense. In this example, first transition 78 bends contact pin away from axis 84 in a first direction while second transition 80 bends said contact pin in a second, opposite direction back toward axis 84. Finally, transition 82 bends in a manner such that distal end 72 is aligned once again with axis 84.

The alignment of proximal end 70 and distal end 72 after forming transition 78, 80, and 82 is ideal. However, in practice, proximal end 70 and distal end 72 can be misaligned relative to each other by as much as, in an example, ±10°, due to tolerances in the formation of one or more transitions 78-82. Accordingly, the description herein of proximal end 70 and distal end 72 being aligned on axis 84 is not to be construed in a limiting sense.

Figure 12B:
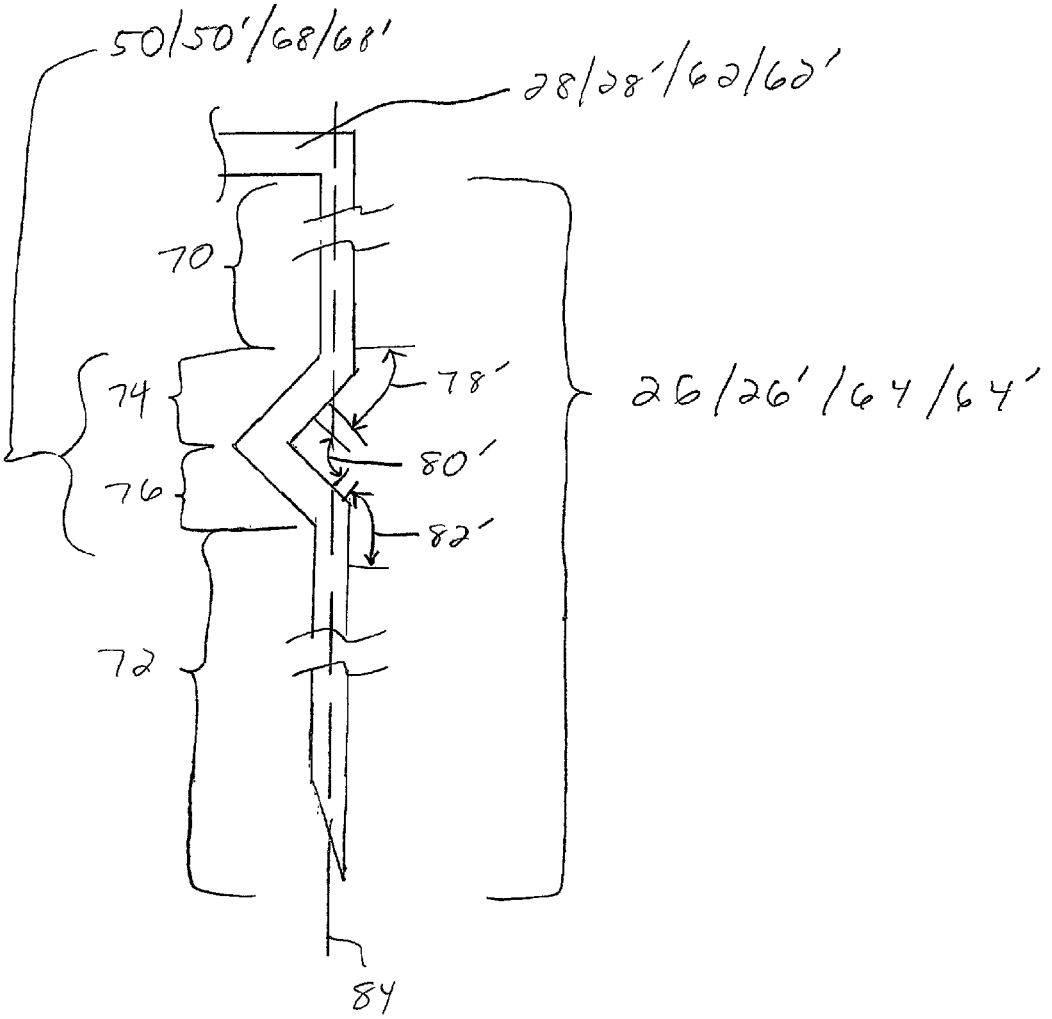
FIG. 12B is an isolated view of another example single contact pin coupled to a contact, wherein the contact pin includes a bent portion.

Referring to FIG. 12B and with continuing reference to FIG. 12A, the example contact pin shown in FIG. 12B is similar in most respects to the example contact pin shown in FIG. 12A with at least the following exceptions: the example contact pin shown in FIG. 12B includes transition 78', 80', and 82' which are bent at sharp angles having minimal radiuses versus transition 78, 80, and 82 in FIG. 12A having curved transitions with discernible radiuses. Other than this difference, the example contact pins shown in FIGS. 12A and 12B are similar.

While FIGS. 12A and 12B show contact pins including curved and bent portions, this is not to be construed in a limiting sense since it is envisioned that a contact pin can be formed of combinations of curved and bent portions.

The examples have been described with reference to the accompanying Figures. Modifications and alterations will occur to others upon reading and understanding the foregoing examples. Accordingly, the foregoing examples are not to be construed as limiting the disclosure.

The invention claimed is:

1. A female electrical connector comprising:

a plurality of walls defining a housing, a female connector inside the housing, and an opening configured to facilitate insertion of a mating male connector into the female connector;

contacts of the female connector positioned in the opening of the housing; and contact pins extending from the contacts of the female connector through at least one of the plurality of walls of the housing for connection to a substrate, wherein each contact pin includes a curved or bent portion disposed in a space between a pair of channels of the housing through which straight sections of the contact pin on opposite sides of the curved or bent portion pass, wherein the curved or bent portion of each contact pin is free to move in said space, and wherein each curved or bent portion comprises:

a first, straight section extending in a first direction from one of the contacts;

a second section extending from the end of the first section opposite the contact and away from the first direction;

a third section extending from the end of the second section opposite the first section and toward the first direction; and a fourth, straight section extending from the end of the third section opposite the second section and in the first direction.

2. The female electrical connector of claim 1, wherein:

the first and second sections are positioned at a first angle to each other;

the second and third sections are positioned at a second angle to each other; and the third and fourth sections are positioned at a third angle to each other.

3. The female electrical connector of claim 2, wherein:

each angle is an obtuse or acute angle; and the transition between at least one of the first and second sections; the second and third sections; and the third and fourth sections is sharp, curved, or both.

4. The female electrical connector of claim 1, wherein:

the second section extends away from the first section at a first, obtuse angle; and the first angle is sharp, curved, or both.

5. The female electrical connector of claim 1, wherein:

the third section extends away from the second section at a second, obtuse or acute angle; and the second angle is sharp, curved, or both.

6. The female electrical connector of claim 1, wherein:

the fourth section extends away from the third section at a third, obtuse angle; and the third angle is sharp, curved, or both.

7. The female electrical connector of claim 1, wherein the first and fourth sections are aligned.

8. The female electrical connector of claim 1, wherein the female connector is a USB connector or an RJ connector.

9. The female electrical connector of claim 1, wherein the substrate is a PCB.

10. The female electrical connector of claim 1, wherein electromagnetic interference (EMI) shielding defines one or more of the plurality of walls.

11. The female electrical connector of claim 10, wherein the EMI shielding:

defines a top wall of the housing; and covers side walls of the housing.

12. The female electrical connector of claim 1, wherein the contact pins extend from a bottom wall of the housing.

13. The female electrical connector of claim 1, wherein each channel is defined by a pair of adjacent projections.

14. The female electrical connector of claim 1, wherein:

an upper section of the contact pin passes through one of the pair of channels; and a lower section of the contact pin passes through the other of the pair of channels.

15. The female electrical connector of claim 1, wherein the straight sections of the contact pin on opposite sides of the curved or bent portion are aligned.

16. A female electrical connector comprising:

a plurality of walls defining a housing, a female connector inside the housing, and an opening configured to facilitate insertion of a mating male connector into the female connector;

contacts of the female connector positioned in the opening of the housing; and contact pins extending from the contacts of the female connector through at least one of the plurality of walls of the housing for connection to a substrate, wherein each contact pin includes a curved or bent portion disposed in a space between a pair of channels of the housing through which straight sections of the contact pin on opposite sides of the curved or bent portion pass, wherein the curved or bent portion of each contact pin is free to move in said space, and wherein each contact pin includes another curved or bent portion disposed in another space between another pair of channels of the housing through which straight sections of the contact pin on opposite sides of the other curved or bent portion pass.

17. A female electrical connector comprising:

a plurality of walls defining a housing, a female connector inside the housing, and an opening configured to facilitate insertion of a mating male connector into the female connector;

contacts of the female connector positioned in the opening of the housing; and contact pins extending from the contacts of the female connector through at least one of the plurality of walls of the housing for connection to a substrate, wherein each contact pin includes a curved or bent portion disposed in a space between a pair of channels of the housing through which straight sections of the contact pin on opposite sides of the curved or bent portion pass, wherein the curved or bent portion of each contact pin is free to move in said space, and wherein the curved or bent portion of each contact pin is part of an otherwise straight section of the contact pin.

* * * * *